US005160249A

United States Patent [19]

Iwai et al.

[11] Patent Number: 5,160,249

[45] Date of Patent: Nov. 3, 1992

[54] CIRCUMFERENTIAL FLOW TYPE FUEL PUMP

[75] Inventors: Shingo Iwai; Hiroshi Yoshioka, both of Hiroshima, Japan

[73] Assignee: Mitsubishi Denki Kabushiki Kaisha, Tokyo, Japan

[21] Appl. No.: 611,505

[22] Filed: Nov. 13, 1990

[30] Foreign Application Priority Data

Nov. 17, 1989 [JP] Japan ..... 1-297478
Nov. 20, 1989 [JP] Japan ..... 1-134979
Feb. 16, 1990 [JP] Japan ..... 2-36682

[51] Int. Cl.[5] ..... F04D 5/00

[52] U.S. Cl. ..... 415/55.3; 415/55.2; 415/169.1

[58] Field of Search ..... 415/55.1, 55.2, 55.3, 415/55.4, 55.5, 55.6, 55.7, 169.1

[56] References Cited

U.S. PATENT DOCUMENTS 4,591,311 5/1986 Matsuda et al. .
4,673,333 6/1987 Kluge .
4,844,621 4/1989 Umemura et al. .

FOREIGN PATENT DOCUMENTS

411428A2 2/1991 European Pat. Off. .
60-79193 4/1985 Japan .
138297 7/1985 Japan ..... 415/55.1
671309 12/1949 United Kingdom .
776635 11/1955 United Kingdom .
898257 6/1962 United Kingdom .
1484581 2/1974 United Kingdom .
1464308 2/1977 United Kingdom .

*Primary Examiner*—Edward K. Look
*Assistant Examiner*—James A. Larson
*Attorney, Agent, or Firm*—Leydig, Voit & Mayer

[57] ABSTRACT

A circumferential flow type fuel pump has a circumferential fuel flow passage provided around an impeller and a gas discharging hole formed in the inner wall of the fuel flow passage in such a manner that the fuel flow passage is communicated with the outside of the fuel pump. The upstream and portion of the fuel flow passage extends to a position near the gas discharging hole and is formed into a flow passage enlarging part by increasing its sectional area radially outwardly, whereby the pumping capacity is substantially maintained unchanged even under severe operation conditions such as at a high fuel temperature.

6 Claims, 3 Drawing Sheets

CIRCUMFERENTIAL FLOW TYPE FUEL PUMP

BACKGROUND OF THE INVENTION

This invention relates to a circumferential flow type fuel pump, and more particularly to a circumferential flow type fuel pump comprising a circumferential flow type liquid pump unit used for a vehicle internal combustion engine.

A conventional circumferential flow type fuel pump for vehicles will be described with reference to FIGS. 1, 2 and 3. FIG. 1 is a sectional view showing the conventional circumferential flow type fuel pump, FIG. 2 is a sectional view taken along line II—II in FIG. 1, and FIG. 3 is a sectional view taken along line III—III in FIG. 2.

As shown in these figures, a pump body 1 comprises an electrical feeder section 2, a rotor 3, a circumferential flow type pump section 4, and an outer cylinder 5. The shaft 3*a* of the rotor 3 is rotatably supported by a first bearing 2*a* in the electrical feeder section 2 and a second bearing 4*a* in the pump section 4.

The pump section 4 is made up of a pump casing 41, an impeller 42, and a pump cover 43. The pump casing 41 is press-fitted in the outer cylinder 5. The pump cover 43 is fixedly secured to the open end of the outer cylinder 5 by caulking. The impeller 42 is interposed between the pump casing 41 and the pump cover 43. The impeller 42 is mounted on the shaft 3*a* of the rotor 3 so that it is rotated together with the latter 3.

First and second recesses 41*a* and 43*a* are formed in the pump casing 41 and the pump cover 43, respectively, in such a manner that they confronted each other. That is, a circumferential fuel flow passage 44 is formed along the peripheral portion of the impeller 42. A number of pumping blades 42*a* are provided on the peripheral portion of the impeller 42 which confronts with the fuel flow passage 44.

The upstream end of the fuel flow path 44 is communicated with a fuel sucking inlet 45 provided in the pump cover 43, while the downstream end is communicated through a fuel discharging outlet 46 provided in the pump casing 41 and a motor chamber 6 with a lead-out section 21 coupled to the electrical feeder section 2.

In the fuel flow passage 44, a portion having a predetermined length from the upstream end is formed into a flow passage enlarging part which increases the section of the flow passage radially inwardly. A small hole, namely, a gas discharging hole 47 is formed in the downstream end portion of the flow passage enlarging section so that the fuel flow passage 44 is communicated with the outside the pump body 1.

Now, the operation of the fuel pump thus constructed will be described.

An external power source applies current through the electrical feeder section 2 to the rotor 3 to rotate the latter. Accordingly, the impeller 41 mounted on the shaft of the rotor 3 is rotated to operate as a pump, so that fuel is sucked in through the fuel sucking inlet 45. The fuel thus sucked is supplied, for instance, to an engine (not shown) via the fuel flow passage 44, the discharging outlet 46, the motor chamber 6 and the lead-out section 21.

If, in this operation, the fuel in the fuel flow passage contains bubbles, the fuel viscosity is decreased, so that the friction between the fuel and the impeller is decreased. That is, the fuel pump is decreased in performance, since it relies on the friction between the impeller 42 and the fuel.

In order to overcome this difficulty, the gas discharging hole 47 is provided to remove the bubbles from the fuel. This will be described in more detail. The bubbles in the fuel are different in specific gravity and accordingly in the centrifugal force acting thereon from the fuel. Therefore, the bubbles are collected in the inner peripheral portion of the fuel flow passage 44, i.e., in the flow passage enlarging part 44*a* while flowing down. As a result, the bubbles are discharged through the gas discharging hole 47 provided in the downstream end portion of the flow passage enlarging part 44*a*.

It is true that, in the conventional circumferential flow type fuel pump for a vehicle, the bubbles in the fuel can be removed to a certain extent. However, the bubble removing capacity is not sufficient. That is, under severe operating conditions, such as at a high fuel temperature, it is impossible to completely remove the bubbles from the fuel, and accordingly, the pumping performance is greatly decreased.

SUMMARY OF THE INVENTION

Accordingly, an object of this invention is to eliminate the above-described problems of a conventional circumferential flow type fuel pump.

More specifically, an object of the invention is to provide a circumferential flow type fuel pump in which the gas discharging capacity is increased, and, in which even under severe operating conditions such as at a high fuel temperature, the decrease of the pumping capacity is minimized.

In a circumferential flow type fuel pump according to a first aspect of the invention, the fuel flow passage includes a flow passage enlarging part which is formed by increasing the sectional area of the upstream end portion of the fuel flow passage radially outwardly. This portion is extended to a position slightly before the gas discharging hole. In the fuel pump, the fuel in the fuel flow passage is caused to flow slightly radially inwardly at the end of the flow passage enlarging part, so that the bubbles flowing along the inner wall ar discharged through the gas discharging hole out of the pump.

In a circumferential flow type fuel pump according to a second aspect of the invention, the fuel flow passage includes a flow passage enlarging part which is formed by increasing the sectional area of the upstream end portion of the fuel flow passage radially outwardly and extending this portion to a position before the gas discharging hole, and a fuel guide recess is provided which is extended to the gas discharging hole from the start point which is located slightly upstream of and on the radially outward side of the gas discharging hole while passing obliquely through the fuel flow passage, the fuel guide recess increasing in depth towards the gas discharging hole. In the fuel pump, the fuel flowing along the outer wall of the fuel flow path is caused to flow slightly radially inwardly at the end of the flow passage enlarging part, thus forming a stream of fuel flowing through the fuel guide recess into the gas discharging hole. Owing to the inertia of the stream of fuel thus formed, the bubbles flowing along the inner wall of the fuel flow passage are efficiently discharged from the pump through the gas discharging hole.

In a circumferential flow type fuel pump according to a third aspect of the invention, the part of the fuel flow passage which extends from the fuel sucking inlet to the gas discharging hole is formed into a flow passage enlarging part by increasing the sectional area radially outwardly of the impeller, and the flow passage enlarging part is coupled to the remaining fuel flow passage through a linear flow passage which is in the form of the chord of a circular arc, and the linear flow passage has the gas discharging hole. In the fuel pump, the flow passage enlarging part is connected to the ordinary pump flow passage through the linear flow passage which is smaller in sectional area, and therefore the bubbles flowing along the inner wall of the passage tend to stay in the linear flow passage, while the fuel pressure is increased in the same linear flow passage. In addition, the gas discharging hole is provided near the inner wall where the bubbles tend to stay. Hence, the bubbles are removed with high efficiency.

The nature, principle and utility of the invention will become more apparent from the following detailed description and the appended claims when read in conjunction with the accompanying drawings.

DETAILED DESCRIPTION OF THE INVENTION

Figure 1:
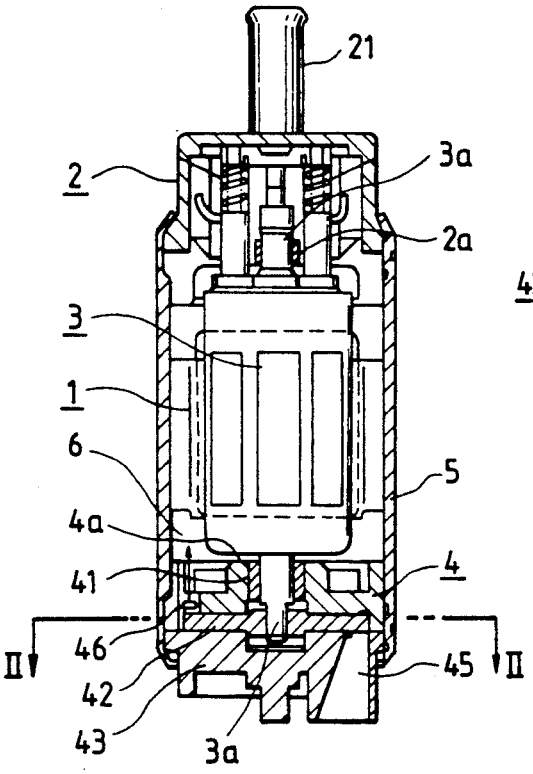
FIG. 1 PRIOR ART
FIG. 1 is a sectional view showing the arrangement of a conventional circumferential flow type fuel pump.
Figure 2:
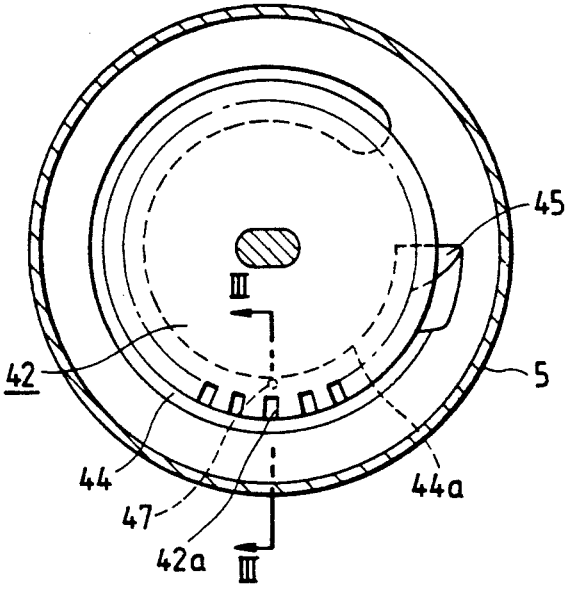
FIG. 2 PRIOR ART
FIG. 2 is a sectional view taken along line II—II in FIG. 1.
Figure 3:
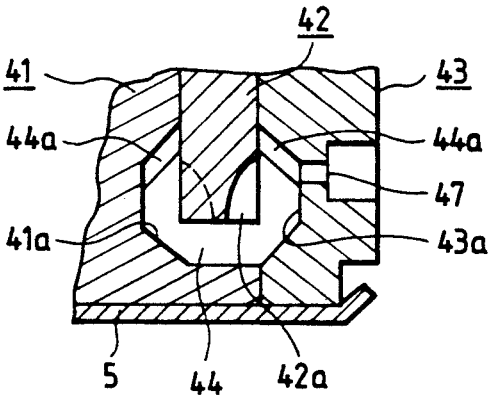
FIG. 3 PRIOR ART
FIG. 3 is a sectional view taken along line III—III in FIG. 2.
Figure 4:
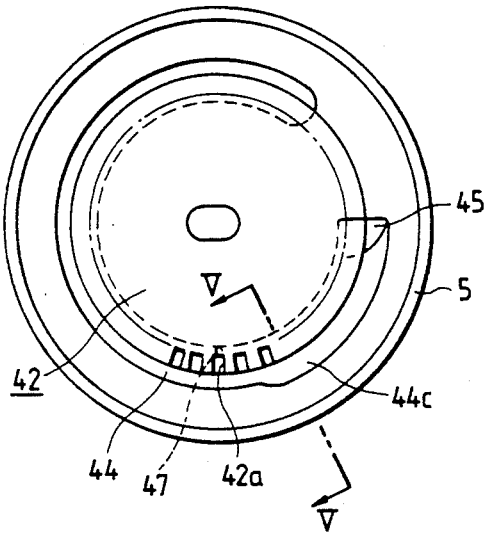
FIG. 4 is a sectional view showing a first embodiment of a circumferential flow type fuel pump of this invention.
Figure 5:
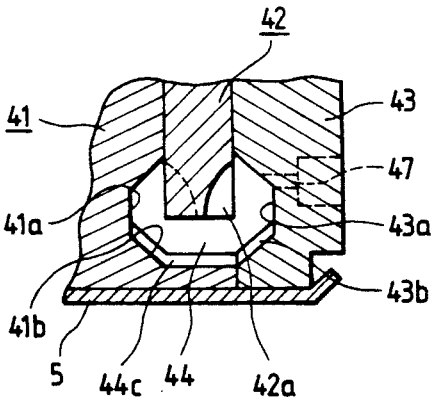
FIG. 5 is a sectional view taken along line V—V in FIG. 5, showing various components of the fuel pump.

A first embodiment of a circumferential flow type fuel pump of this invention will be described with reference to FIGS. 4 and 5, in which those components which have been previously described with reference to FIGS. 1 through 3 are designated by the same reference numerals or characters.

In the fuel pump, the inner wall of the fuel flow passage 44 is circular and has a gas discharging hole 47 formed therein which is similar to that of the conventional fuel pump described above. In the fuel flow passage 44, a portion extended from the upstream end to slightly before the gas discharging hole 47 is formed into a flow passage enlarging part 44*c* by increasing the section of the fuel flow passage 44 radially outwardly. The flow passage enlarging part is made up of first and second enlarging portions 41*b* and 43*b* which are formed in the first and second recesses 41*a* and 43*a*, respectively.

In the circumferential flow type fuel pump thus constructed, when bubbles are contained in the fuel in the fuel flow passage 44, similarly to the case of the conventional circumferential flow type fuel pump those bubbles are collected in the fuel flow passage while being moved radially inwardly or being moved towards the inner wall of the fuel flow passage. On the other hand, the fuel in the downstream end portion of the fuel flow passage 44 is increased in pressure, because the downstream end portion is smaller in sectional area. Hence, the fuel therein is caused to flow slightly towards the inner wall of the fuel flow passage 44. Accordingly, the bubbles in the fuel, which flow along the inner wall of the fuel flow passage, are forcibly removed through the gas discharging hole 47 out of the pump. In this connection, it should be noted that, since the bubbles are different in specific gravity and accordingly in the centrifugal force acting thereon from the fuel, they hardly flow downstream of the gas discharging hole 47. In the portion of the fuel flow passage which is located downstream of the flow passage enlarging part 44*c*, bubbles are scarcely formed because the fuel pressure is increased as was described above.

Thus, almost all the bubbles have been removed from the fuel in the fuel flow passage 44. Hence, even under severe operation conditions such as at a high fuel temperature, decrease of the pumping capacity is minimized.

The dimensions of the flow passage enlarging part 44*c* are not particularly limited. However, if the dimensions are excessively large, then the pumping action of the impeller will not be applied to the flow passage enlarging part. Accordingly, it is desirable that the portion of the fuel flow passage 44 which is formed into the flow passage enlarging part 44*c* be larger in sectional area by 20 to 30% than the portion downstream thereof.

In addition to the above-described flow passage enlarging part 44*c*, it is possible to provide a conventional flow passage enlarging part 44*a* (FIG. 2) which is obtained by increasing the section of the fuel flow passage 44 radially inwardly.

While a circumferential flow type vehicle fuel pump has been described, it goes without saying that the technical concept of the invention can be applied to other circumferential flow type fuel pumps.

In the circumferential flow type fuel pump according to the invention, in the fuel flow path, the portion extended from the upstream end to slightly before the gas discharging hole is formed into a flow passage enlarging part by increasing the section of the fuel flow passage 44 radially outwardly so that the bubbles in the fuel are discharged through the gas discharging hole out of the pump. Thus, with the circumferential flow type fuel pump of the invention, even under severe operating condition such as at a high fuel temperature, a decrease of the pumping capacity is minimized.

A second embodiment of this invention in the form of a circumferential flow type vehicle fuel pump will be described with reference to FIGS. 6 and 7, in which parts corresponding functionally to those which have been previously described with reference to FIGS. 1 through 5 are designated by the same reference numerals or characters.

Figure 6:
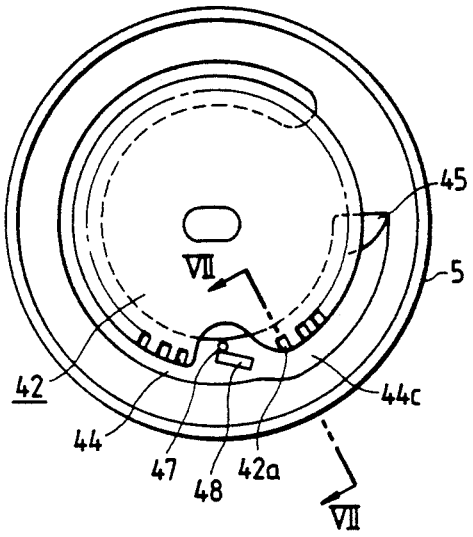
FIG. 6 is a sectional view showing a second embodiment of a circumferential flow type fuel pump of this invention.
Figure 7:
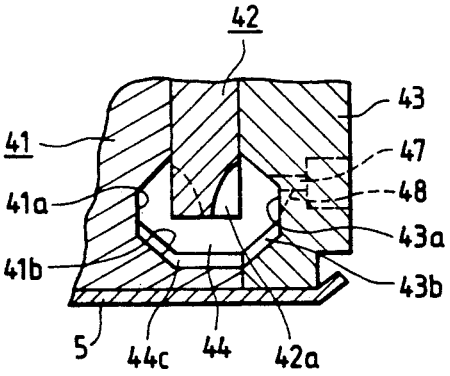
FIG. 7 is a sectional view taken along line VII—VII in FIG. 6, showing various components of the fuel pump.

In FIGS. 6 and 7, reference numeral 48 designates a fuel guide recess. The fuel guide recess 48 extends to the gas discharging hole 47 from a start point which is located slightly upstream of and on the radially outward side of the gas discharging hole 47; that, it is extends to the gas discharging hole while passing obliquely through the fuel flow passage 44. The fuel guide recess 48 is so formed that it increases in depth from the start point towards the gas discharging hole 47.

In the vehicle fuel pump thus constructed, when bubbles are contained in the fuel in the fuel flow passage 44, similarly to the above-described case the bubbles are collected along the inner wall of the fuel flow passage 44. On the other hand, the portion of the fuel flow passage which is located downstream of the flow passage enlarging part 44*c* is smaller in sectional area and therefore the fuel therein is higher in pressure, so that the fuel is caused to flow slightly radially inwardly, i.e., towards the inner wall of the fuel flow passage. Because of the higher fuel pressure and the inertia of the fuel flow, the fuel led into the fuel guide recess is efficiently introduced towards the gas discharging hole 47. Thus, the fuel is allowed to stably flow from the downstream end of the flow passage enlarging part 44*c* towards the gas discharging hole 47. As a result, the fuel containing the bubbles flowing along the inner wall of the fuel flow passage 44 is caused to flow together with the stream of fuel which flows from the downstream end of the flow passage enlarging part 44*c* towards the gas discharging hole 47, so that the bubbles are forcibly discharged out of the pump.

Since the bubbles are different in specific gravity and accordingly in the centrifugal force acting thereon from the fuel, they hardly flow downstream of the gas discharging hole 47. In the portion of the fuel flow passage, which is located downstream of the flow passage enlarging part 44*c*, bubbles are scarcely formed because the fuel pressure is increased as was described above.

Thus, almost all the bubbles have been removed from the fuel in the fuel flow passage 44. Hence, even under severe operation conditions such as at a high fuel temperature, a decrease of the pumping capacity is minimized.

The dimensions of the flow passage enlarging part 44*c* are not particularly limited. However, if the dimensions are excessively large, then the pumping action of the impeller will not be applied to the flow passage enlarging part. Accordingly, it is desirable that the portion of the fuel flow passage 44 which is formed into the flow passage enlarging part 44*c* be larger in sectional area by 20 to 30% than the portion downstream thereof.

In the circumferential flow type fuel pump of the present invention, in the fuel flow passage, the portion extended from the upstream end to slightly before the gas discharging hole is formed into the flow passage enlarging part by increasing the section of the fuel flow passage radially outwardly, and the fuel guide recess is provided in such a manner that it is extended to the gas discharging hole from a point which is located slightly upstream of and on the radially outward side of the gas discharge hole so that the bubbles can be forcibly removed with the fuel flowing in the gas discharging hole out of the pump. Therefore, the gas discharging capacity is improved. Thus, with the circumferential flow type fuel pump of the present invention, even under severe operating condition such as at a high fuel temperature, a decrease of the pumping capacity is minimized.

A third embodiment of the invention in the form of a circumferential flow type fuel pump will be described with reference to FIGS. 8 and 9, in which parts corresponding functionally to those which have been described with reference to FIGS. 1 through 3 are designated by the same reference numerals or characters.

Figure 8:
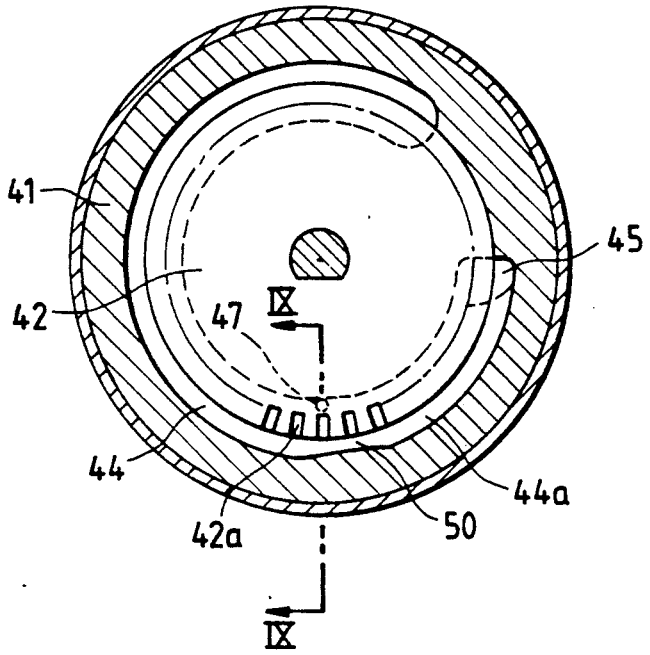
FIG. 8 is a sectional view showing a third embodiment of a circumferential flow type fuel pump of this invention.
Figure 9:
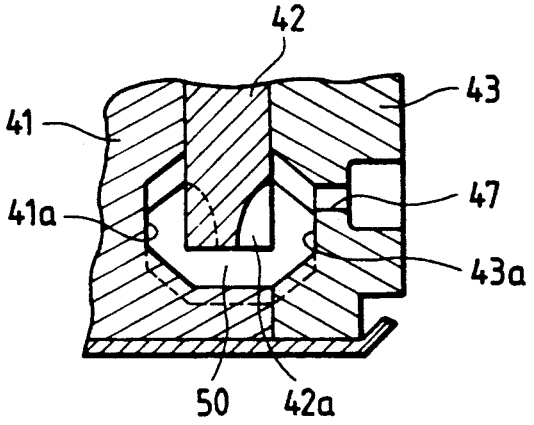
FIG. 9 is a sectional view taken along line IX—IX in FIG. 8, showing various components of the fuel pump.

The fuel pump shown in FIGS. 8 and 9, has a linear flow passage 50 between the flow passage enlarging part 44*a* and the fuel flow passage 44. The linear flow passage 50 corresponds to a chord of the arcuate flow passage. The linear flow passage 50 is so shaped that its distance from the center of rotation of the impeller 42 is smaller towards the midpoint of the linear flow passage 50. In other words, the width is gradually increased from the midpoint toward the fuel flow passage 44. A gas discharging hole 47 is formed in the linear flow passage 50.

The operation of the circumferential flow type fuel pump thus constructed will be described.

Sometimes, the fuel flowing in the fuel flow passage 44 contains bubbles, or it forms bubbles therein when it is high in temperature. As was described before, since the fuel and the bubble are different from one another in specific gravity and accordingly in the centrifugal force acting thereon, in the fuel flow passage 44 the bubbles will flow along the inner wall of the fuel flow passage 44 while the fuel will flow along the outer wall. The flow passage enlarging part 44*a* is larger in volume than the fuel flow passage 44. The bubbles flowing along the inner wall of the fuel flow passage 44 tend to stay along the linear flow passage 50 because the distance of the bubbler from the center of rotation of the impeller is decreased there and accordingly the centrifugal force applied thereto is also reduced. On the other hand, the fuel flowing along the outer wall of the fuel flow passage is forced to flow into the linear flow passage 50 which is smaller in sectional area. As a result, in the linear flow passage 50 the fuel pressure is increased, and the fuel is partially discharged together with the bubbles through the gas discharging outlet 47.

Thus, the bubbles are substantially removed from the fuel flowing in the fuel flow passage 44, with the result that a decrease of the pumping capacity can be prevented.

As was described above, in the circumferential flow type fuel pump, a part of the fuel flow passage is formed into a linear flow passage which corresponds to a chord of the arcuate flow passage, and a gas discharging hole is formed in the linear flow passage. Hence, the fuel flow passage can be formed with ease, and the pumping capacity is maintained substantially unchanged even when bubbles are contained in the fuel flowing in the fuel flow passage.

While the present invention has been described in connection with preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A circumferential flow type fuel pump comprising:

an impeller having a periphery;

a circumferential fuel flow passage provided along the periphery of the impeller and having an inner wall, an outer wall having an upstream region and a downstream region distanced radially inward from the upstream region, and a gas discharging hole communicating between the inner wall and the outside of the pump, the fuel flow passage having a larger cross section along the upstream region than along the downstream region; and a fuel guide recess extending to the gas discharging hole from a start point which is located slightly upstream of and on a radially outward side of the gas discharging hole and passes obliquely through the fuel flow passage.

2. A circumferential flow type fuel pump comprising:

an impeller having a periphery and blade grooves on the periphery;

a pump cover and a pump casing which rotatably support the impeller and define an arcuate fuel flow passage surrounding the impeller, the fuel flow passage having an arcuate upstream region and a linear flow passage adjoining the upstream region and comprising a chord of the fuel flow passage and having a smaller cross-sectional area than the upstream region;

a fuel inlet provided in the pump cover and a fuel outlet provided in the casing, the inlet and the outlet communicating with the fuel flow passage; and a gas discharging hole communicating between the fuel flow passage and the outside of the fuel pump.

3. A circumferential flow type fuel pump as claimed in claim 2 wherein the fuel flow passage comprises a downstream region having a larger cross-sectional area than the linear flow passage, the linear flow passage extending between the upstream and downstream regions.

4. A circumferential flow type fuel pump as claimed in claim 2 wherein the fuel flow passage has an inner wall and an outer wall, both of which have a smaller radius in the linear flow passage than in the upstream portion.

5. A circumferential flow type pump as claimed in claim 2 wherein the linear flow passage is closer to the inlet than to the outlet.

6. A circumferential flow type pump as claimed in claim 2 wherein the linear flow passage has an inner periphery, and the gas discharging hole is disposed along the inner periphery.

* * * * *